US011980264B2

(12) United States Patent
Wong et al.

(10) Patent No.: US 11,980,264 B2
(45) Date of Patent: May 14, 2024

(54) MULTI-PURPOSE PORTABLE FAN

(71) Applicants: Kevin Wong, Jurupa Valley, CA (US); Stevin Wong, Jurupa Valley, CA (US)

(72) Inventors: Kevin Wong, Jurupa Valley, CA (US); Stevin Wong, Jurupa Valley, CA (US)

( * ) Notice: Subject to any disclaimer, the term of this patent is extended or adjusted under 35 U.S.C. 154(b) by 239 days.

(21) Appl. No.: 15/810,020

(22) Filed: Nov. 11, 2017

(65) Prior Publication Data

US 2018/0160782 A1 Jun. 14, 2018

Related U.S. Application Data

(60) Provisional application No. 62/547,903, filed on Aug. 21, 2017, provisional application No. 62/432,562, filed on Dec. 9, 2016.

(51) Int. Cl.
*A45B 27/02* (2006.01)
*F04D 29/00* (2006.01)

(52) U.S. Cl.
CPC ..... *A45B 27/02* (2013.01); *F04D 29/00* (2013.01); *F04D 29/005* (2013.01)

(58) Field of Classification Search
CPC ..... A45B 27/02; F04D 29/005; F04D 29/00
USPC ..... 416/69, 70 R, 71, 72, 73, 70 A
See application file for complete search history.

(56) References Cited

U.S. PATENT DOCUMENTS 175,257 A * 3/1876 Robison ..... A45B 27/00 416/73
1,630,397 A * 5/1927 Marui ..... A45B 27/00 416/73
2,334,298 A * 11/1943 Vallone ..... A45B 27/00 416/71
3,010,645 A * 11/1961 Mandelstam ..... F21V 33/00 416/5
6,175,354 B1 * 1/2001 Blissett ..... F04D 29/38 345/110
6,776,579 B2 * 8/2004 Shiratori ..... A45B 27/00 416/5
6,793,460 B2 * 9/2004 DuBois ..... A45B 27/00 416/70 A
7,161,256 B2 * 1/2007 Fang ..... H02K 7/1807 290/1 R (Continued)

FOREIGN PATENT DOCUMENTS

JP 2003870871 A * 11/2003

*Primary Examiner* — Woody A Lee, Jr.
*Assistant Examiner* — Justin A Pruitt
(74) *Attorney, Agent, or Firm* — The Law Firm of Andrea Hence Evans, LLC

(57) ABSTRACT

A Multi-Purpose Portable Fan, which may include a hand-held-style fan to enhance the atmosphere at an event while having a mobile device application, which may be able to summon aid when needed. The hand-held style fan may have located in a handle and/or otherwise lights, or a fan array with LED lights. The handle may be configured with a multi-position switch, a global positioning system-enabled location transmitter and/or receiver, at least one universal serial bus port, at least one solar panel, a battery status display, a wiring interface for LED lights and/or other included electronic devices, and a mobile device application interface. The mobile device application may include at least one interface such as a sign-in interface, a color-select interface, and a situation interface.

19 Claims, 8 Drawing Sheets

(56) References Cited

U.S. PATENT DOCUMENTS

| | | | | |
|---|---|---|---|---|
| 8,890,775 | B2 * | 11/2014 | Kobayashi | G09F 9/33 345/204 |
| 8,945,328 | B2 * | 2/2015 | Longinotti-Buitoni | A61B 5/0002 156/234 |
| 9,426,638 | B1 * | 8/2016 | Johnson | H04W 4/90 |
| 9,860,077 | B2 * | 1/2018 | Laurent | H04L 12/282 |
| 10,914,309 | B1 * | 2/2021 | Rivers | A45B 27/00 |
| 2007/0243072 | A1 * | 10/2007 | Tepporn | A45B 27/00 416/70 A |
| 2009/0102617 | A1 * | 4/2009 | Thommes | G05B 15/02 340/12.3 |
| 2011/0058945 | A1 * | 3/2011 | Hu | F03B 17/061 416/146 R |
| 2011/0194252 | A1 * | 8/2011 | Wang | A45B 27/02 361/695 |
| 2012/0212339 | A1 * | 8/2012 | Goldblatt | G08B 25/016 340/539.11 |
| 2015/0132125 | A1 * | 5/2015 | Meunier | F04D 29/541 415/213.1 |

* cited by examiner

MULTI-PURPOSE PORTABLE FAN

BACKGROUND OF THE INVENTION

1. Field of the Invention

The present invention is a multi-purpose portable fan used to cool a person when over-heated and includes GPS locating, and lights, may also include portable phone charger, and a tool for networking with others, ability to inform others of the user's location in the case of a need to communicate the user's location and can be used for synchronization purposes during events such as concerts, music festivals and other special events and may also include switches or multi-mode switches and associated circuitry and software to operate and sequence lights and if present vibration, and/or audio, wireless or remote control, and can be used for synchronization purposes during events such as concerts, music festivals and other special events.

2. Description of the Related Art

The present invention can be used by public event goers such as concert goers that attend music festivals to have fun and enjoy listening to their favorite DJs, artists, bands, singers. However, we often hear about people ending up in hospitals due to drug overdose, heat strokes, and dehydration at large music festivals. With music festivals being very crowded, people tend to lose each other while their phones tend to run out of battery power. The current invention is based on a device that will help public event goers have a safe and enjoyable time. The invention is a multi-purpose portable fan to keep users cool when over-heated with LED or other lights and may include a solar powered USB that is able to charge phones.

Events and concerts often draw large crowds of people who gather to share the overall experience and atmosphere of the event. These large crowds of people can be diverse and include people of many ages and types. Due to hot weather, many people can suffer from heat strokes. It is not uncommon for paramedics or other medical personnel to be called to assist event-goers who may have lost consciousness, may have heat stroke, may be dehydrated, or may have another other serious medical injury which may need prompt attention. While in such a crowd, it may be a challenge for paramedics or other medical personnel to locate persons in need of assistance. In extreme cases, even a few seconds difference in locating a person in need of assistance can be the difference between surviving or not. A suitable solution is desired. It would be helpful to have a hand-held fan available when they are in need to cool themselves off. Not only will the fan cool people down, it can also illuminate and light up the entire festival with an app that will be able to control the LED color of the fan. The fan will be a one of a kind fan because the app allows the crowds to network with each other and meet new people. This is not just only a hand-held fan but also adds entertainment with lights and fun. The invention is a multi-purpose portable fan to keep users cool when over-heated with LED or other lights and may include a solar powered USB that is able to charge phones.

Many people attend concert venues and music festivals throughout the day and their phone battery loses power as the day goes on. Users have difficulty finding convenient places to charge their phones. When the battery dies out, it is difficult for users to communicate with their friends and loved ones or to meet up with people at the festival. The fan in at least one embodiment is powered by solar energy. The small solar panel will use the sun's ray to power up the pack that will charge the phone via USB. This gives the phone a longer battery life so users can capture and share memories with their friends and family.

Many people go to concerts to socialize, have fun, network and meet new people while watching their favorite DJ, band, artist, etc. The fan will have an application on IOS and Android that registers the fan owners in a database. This allows all fan owners to meet and greet each other. If, for instance, a fan owner would like to meet someone or a group they will be able to FAN IN (Like) or FAN OUT (Dislike) the person. This allows an opportunity to make new friends and even hook up. Also, as soon as they are going to meet each other and they are very close by, both fans would light up and the lights would start dancing until they connect. GPS is used to identify the location of the fans.

In many music festivals, people tend to pass out because they are intoxicated with drugs or alcohol. The fan has a button that includes an S.O.S feature. Once the button is pushed, it will alert all the fans in the event area within a thirty-foot radius and change to a specified color and also will send a signal to alert the proper authorities. This fan can show the area of where the person is in need of assistance and allows for the user or person(s) in need to receive the necessary assistance as fast as possible by using GPS location detection.

Wherever people are, whether they're away at work, at the beach, or at music festivals, people always want to make sure their love ones are safe. Some people may be in danger when they are lost and alone and most wouldn't know what to do if they are faced with danger. The fan has a button that sends out an alert if loved ones are missing and they are trying to get a hold of them and the fan will vibrate at the same time. With GPS, the fan can track the time and last location. Therefore, the fan can be used to notify loved ones of the last location their loved one is/was and send an alert.

Various attempts have been made to solve problems found in mobile device accessory and location system art. Among these are found in: U.S. Patent and Publication Nos. 2007/0,255,807 to Hayashi, et al.; 2011/0,194,252 to Wang; U.S. Pat. No. 7,548,753 to Millard, et al.; U.S. Pat. No. 8,768,294 to Reitnour, et al; and U.S. Pat. No. 9,326,556 to Leon. This prior art is representative of personal cooling fan accessories and global positioning system locators.

None of the above inventions and patents, taken either singly or in combination, is seen to describe the invention as claimed. Thus, a need exists for Multi-Purpose Portable Fan with the above-mentioned accessories to avoid the above-mentioned problems.

SUMMARY OF THE INVENTION

The present invention advantageously fills the deficiencies by mobile device accessories, USB power and location systems. The present invention is superior to other inventions in that it effectively provides a Multi-Purpose Portable Fan unlike any other fan.

The Multi-Purpose Portable Fan may be configured to enhance a party-atmosphere visual enhancement, as well as provide a means to direct aid request service personnel to a location when needed. The Multi-Purpose Portable Fan may include a hand-held style fan and a mobile device application. The multi-purpose hand-held style fan may have a handle and a fan array with LED lights. The handle may be configured with a three-position switch, a global positioning system-enabled location transmitter, a universal serial bus port, a solar panel, a battery status display, a wiring interface for LED lights, and a mobile device application interface. The mobile device application may include a sign-in interface, a color-select interface, and an aid request interface.

A method of using an Multi-Purpose Portable Fan include placing the three-position switch in the LED light position to illuminate the fan array with LED lights, sending a wireless signal to the user's mobile device, and activating an associated mobile device application where the user may be able select the color, and alternately the flashing pattern, of the LED lights. Placing the three-position switch in the aid request position may send a wireless signal to the user's mobile device, which may activate the associated mobile device application and the global positioning system-enabled location transmitter to signal aid request service providers that a person is in distress. Concurrently, the user's fan array with LED lights may change to display a red color and fan assemblies proximate to the user's fan array with LED lights may also switch to display a red color.

The features of the invention which are believed to be novel are particularly pointed out in the specification. The present invention now will be described more fully hereinafter with reference to the accompanying drawings, which are intended to be read in conjunction with both this summary, the detailed description and any preferred and/or embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The figures which accompany the written portion of this specification illustrate embodiments and method(s) of use for the present invention, at least one current embodiment of a Multi-Purpose Portable Fan, constructed and operative according to the teachings of the present invention.

The various embodiments of the present invention will hereinafter be described in conjunction with the appended drawings, wherein like designations denote like elements.

DETAILED DESCRIPTION

Figure 1:
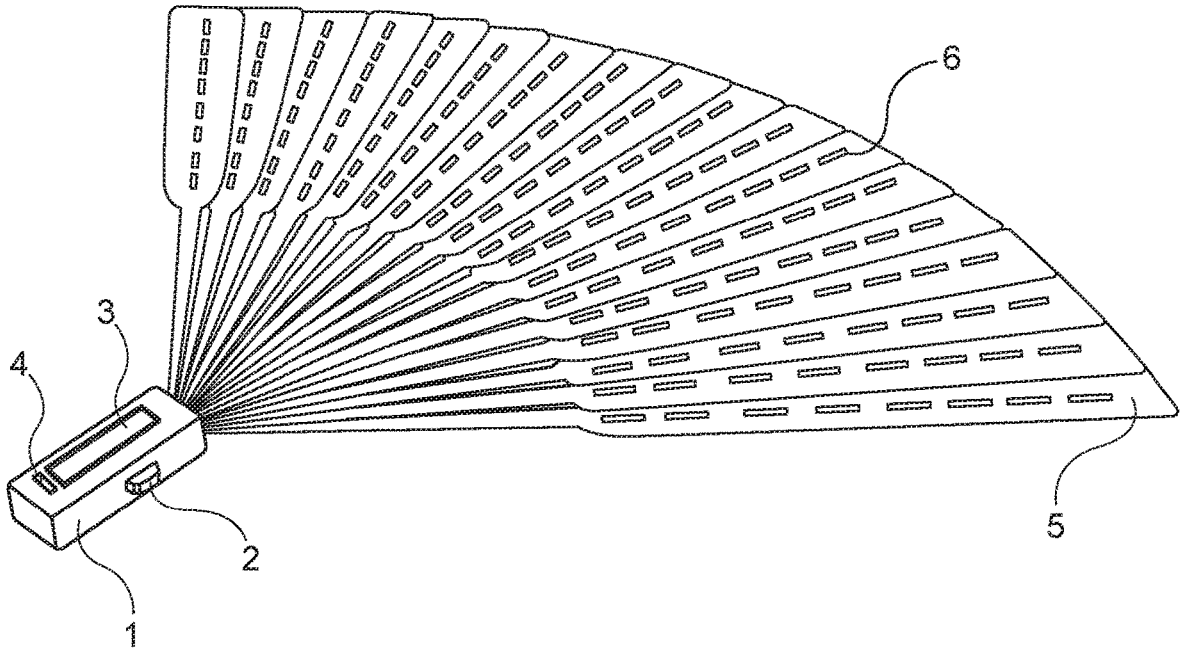
FIG. 1 is a perspective view of a Multi-Purpose Portable Fan during a 'ready-to-use' condition showing a fan according to an embodiment of the present invention.

The present invention is directed to a Multi-Purpose Portable Fan. The Multi-Purpose Portable Fan may comprises fan assembly. In one embodiment of the present invention, the Multi-Purpose Portable Fan assembly may comprise a hand-held style of a fan and a mobile device application to enhance the atmosphere at an event while having a mobile device application which may be able to summon aid request service personnel when needed. The hand-held style fan may have a handle and a fan array with LED lights.

The handle may in at least one embodiment be configured with a three-position switch, a global positioning system-enabled location transmitter, a universal serial bus port, a solar panel, a battery status display, a wiring interface for LED lights, and a mobile device application interface. The three-position switch may have an off position, an LED light position, and an aid request position.

In at least one embodiment when placed in the LED light position, the fan array with LED lights may illuminate and a wireless signal may be sent to the user's mobile device which may activate the associated mobile device application. When placed in the aid request position, a wireless signal may be sent to the user's mobile device which may activate the associated mobile device application, and may simultaneously change color of the fan array with LED lights to a red color.

In at least one embodiment the universal serial bus port may have an interface to the female connector receiver of a mobile device and may further be configured to transfer energy from the solar panel to charge the battery of the mobile device. The battery status display may be configured to show the battery power available of the mobile device when connected to the universal serial bus port.

Referring now to the hand-held style of fan, the fan array if present with LED lights may be configured to be a plurality of nestable blades. The plurality of nestable blades may be configured to spread into a half-circle formation for use, and to retract into a stack for storage. The plurality of nestable blades may also have a plurality of LED lights, wiring, and a wiring connector that may be able to couple with the wiring interface in the handle.

Now referring to the mobile device application, the mobile device application may include a sign-in interface, a color-select interface, and an aid request interface. The sign-in interface may include text input interfaces for a user name and password. The color-select interface may allow a user to select colors and patterns for the fan array with LED lights to display when illuminated.

The color-select interface may further include selections for a plurality of colors, and alternately at least one flashing pattern for the LED lights to display. The plurality of colors for the color-select interface may exclude the color red. In referring now to the aid request interface, the aid request interface may include a text input box for a user to input a personal identification number and a selection interface to activate the global positioning system-enabled location transmitter, which may transmit a signal to notify aid request service providers that a person may be in distress. Additionally, the selection interface to activate the global positioning system-enabled location transmitter may also change the color of the LED lights on the user's fan array, as well as event fan assemblies proximate to the user, to a red color to provide a visual reference for aid request service providers.

A method of using a Multi-Purpose Portable Fan assembly in at least one embodiment may include placing the three-position switch in the LED light position to illuminate the fan array with LED lights, sending a wireless signal to the user's mobile device, and activating an associated mobile device application where the user may be able select the color, and alternately the flashing pattern, of the LED lights. Placing the three-position switch in the aid request position may send a wireless signal to the user's mobile device, which may activate the associated mobile device application and the global positioning system-enabled location transmitter to signal aid request service providers that a person is in distress. Concurrently, the user's fan array with LED lights may change to display a red color and fan assemblies proximate to the user's fan array with LED lights may also change to display a red color.

Referring now to the drawings, there is shown in FIG. 1 a Multi-Purpose Portable Fan during a 'ready-to-use' condition. The hand-held style fan may have a fan array with LED lights and a handle. The fan array with LED lights may be configured to include a plurality of nestable blades. The plurality of nestable blades may be configured to spread into a half-circle formation for use, and to retract into a stack for storage. The plurality of nestable blades may retain a plurality of LED lights, wiring, and a wiring connector that may be able to couple with the wiring interface in the handle. Further, the plurality of nestable blades may be substantially made of resilient, translucent materials.

Figure 2:
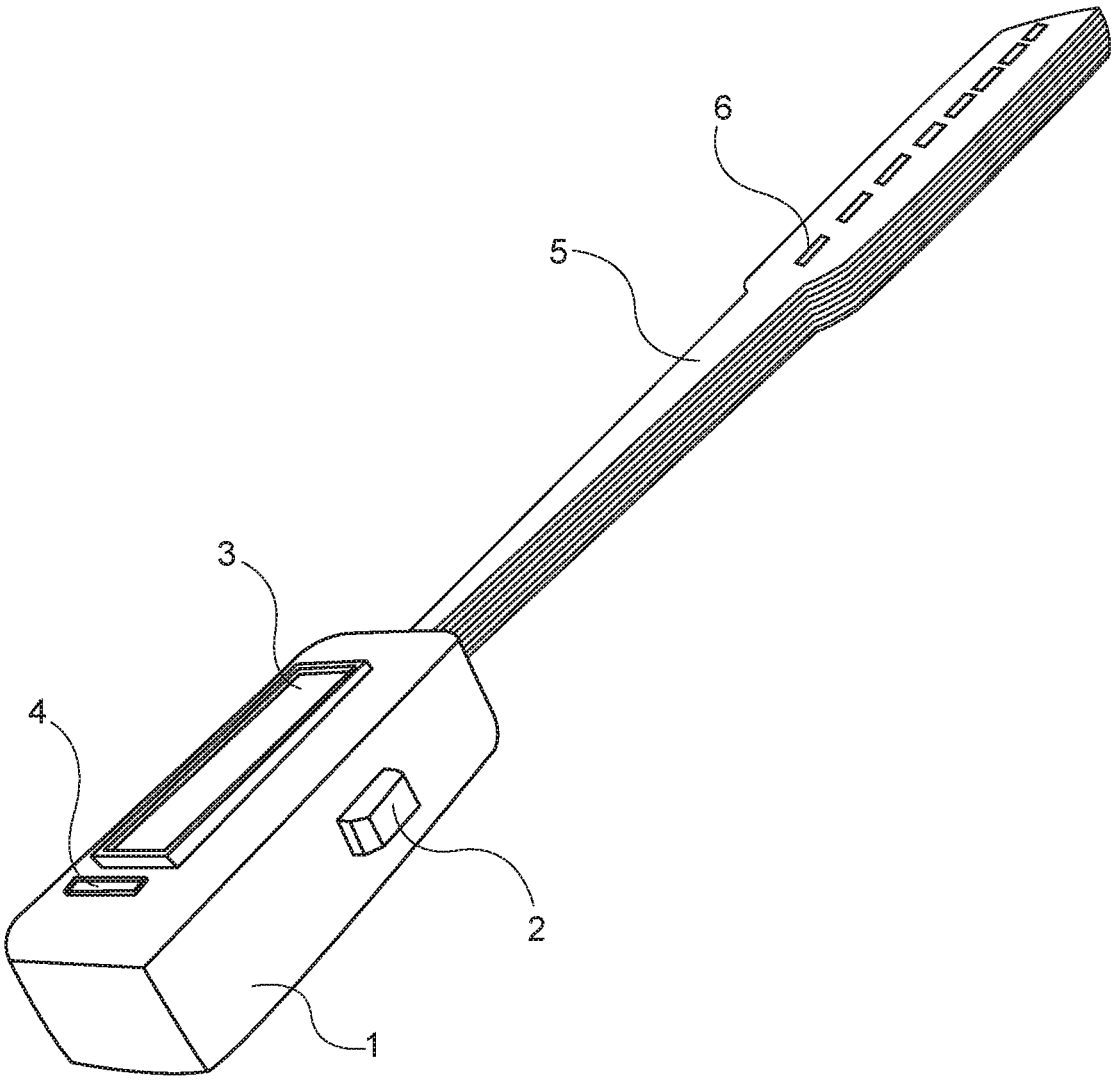
FIG. 2 is a top view illustrating a Multi-Purpose Portable Fan according to an embodiment of the present invention.

Referring now to FIG. 2 showing a top view of a hand-held style fan. In particular, the handle may be configured with a three-position switch, a global positioning system-enabled location transmitter, a universal serial bus port, a solar panel, a mobile device application interface, a battery status display, and a wiring interface for the LED lights in the fan array. The three-position switch may have an off position, an LED light position, and an aid request position. When placed in the LED light position, the fan array with LED lights may illuminate and a wireless signal may be sent to the user's mobile device which may activate the associated mobile device application. When placed in the aid request position, a wireless signal may be sent to the user's mobile device which may also activate the associated mobile device application.

The universal serial bus port may have an interface to the female connector receiver of a mobile device and may further be configured to transfer energy from the solar panel to charge the battery of the mobile device, and alternately to power the plurality of LED lights. The battery status display may be configured to show the battery power available of the mobile device when connected to the universal serial bus port.

Figure 3:
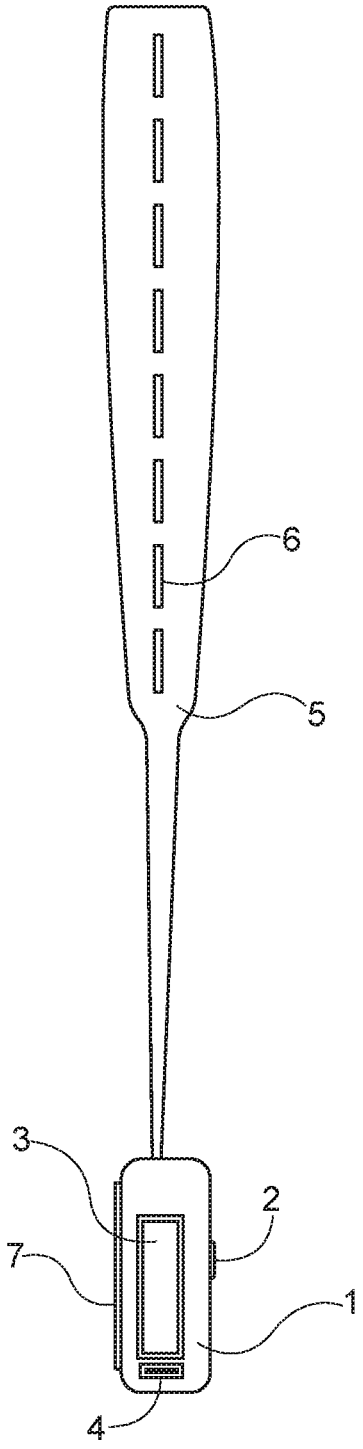
FIG. 3 is a perspective view illustrating a Multi-Purpose Portable Fan according to an embodiment of the present invention.

Referring now to FIG. 3 showing a perspective view of the hand-held style fan showing in particular the plurality of nestable blades in a stored condition, the three-position switch, the solar panel, and the universal serial bus port.

Figure 4:
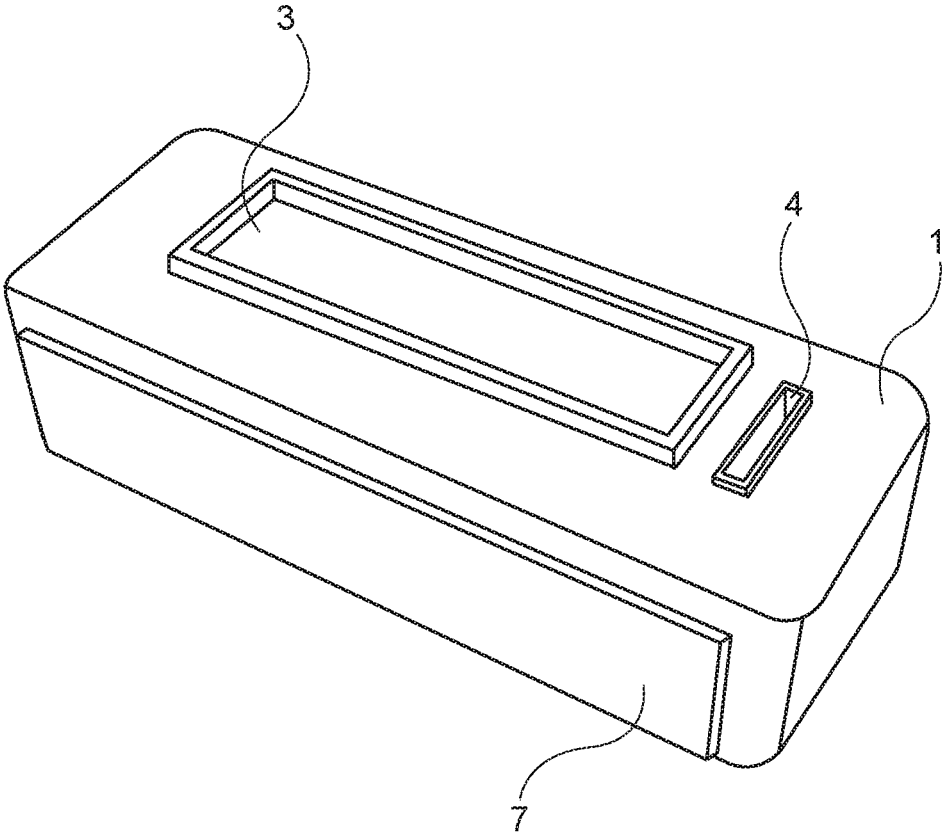
FIG. 4 is a top front-side view of the Multi-Purpose Portable Fan handle device according to an embodiment of the present invention.

Referring now to FIG. 4 showing a front view of the sign-in interface for the mobile device application. The sign-in interface may include text input interfaces for a user name and password. An option to add and display profile picture may be included in the sign-in interface.

Figure 5:
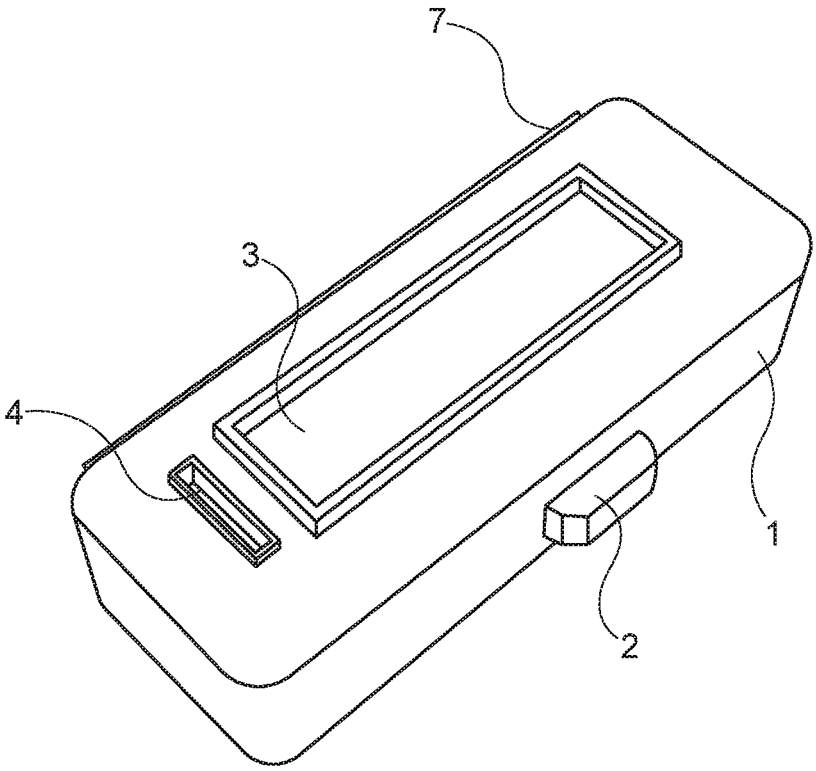
FIG. 5 is a top view illustrating the Multi-Purpose Portable Fan according to an embodiment of the present invention.

Referring now to FIG. 5 showing a front view of the color-select interface for the mobile device application. The color-select interface may be activated by a user selecting the LED light position on the three-position switch on the handle of the hand-held style fan. The color-select interface may allow a user to select from a plurality of colors and flashing patterns for the fan array with LED lights to display when powered on. The color-select interface may exclude the color red from the selection of the plurality of colors. In addition, the color interface may have a selector to activate the aid request interface of the mobile device application, if desired.

Figure 6:
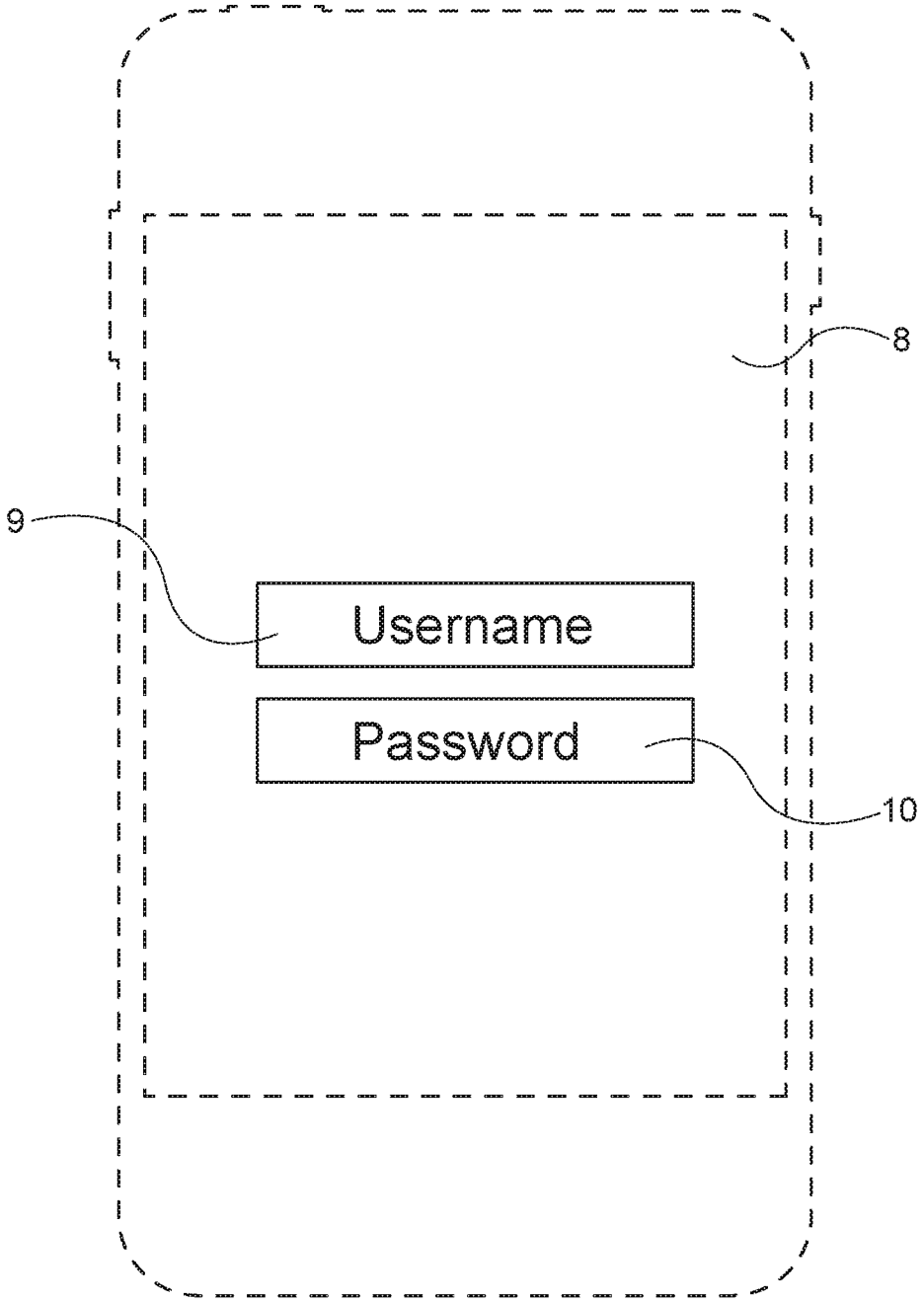
FIG. 6 is a front view of the Multi-Purpose Portable Fan device showing the place to enter color and S.O.S. information according to an embodiment of the present invention.
Figure 7:
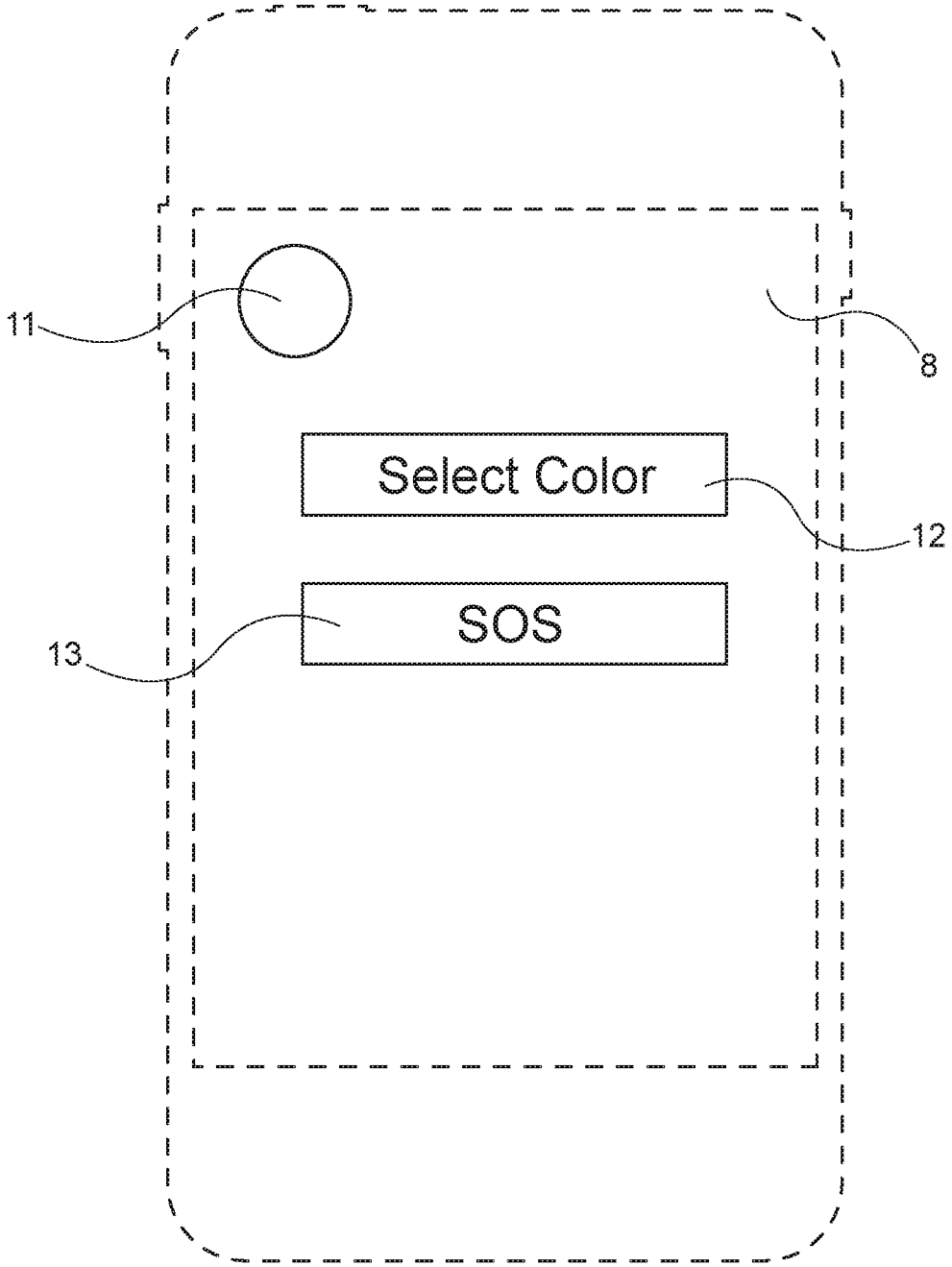
FIG. 7 is a front view of the Multi-Purpose Portable Fan device showing the place to enter username and password according to an embodiment of the present invention.
Figure 8:
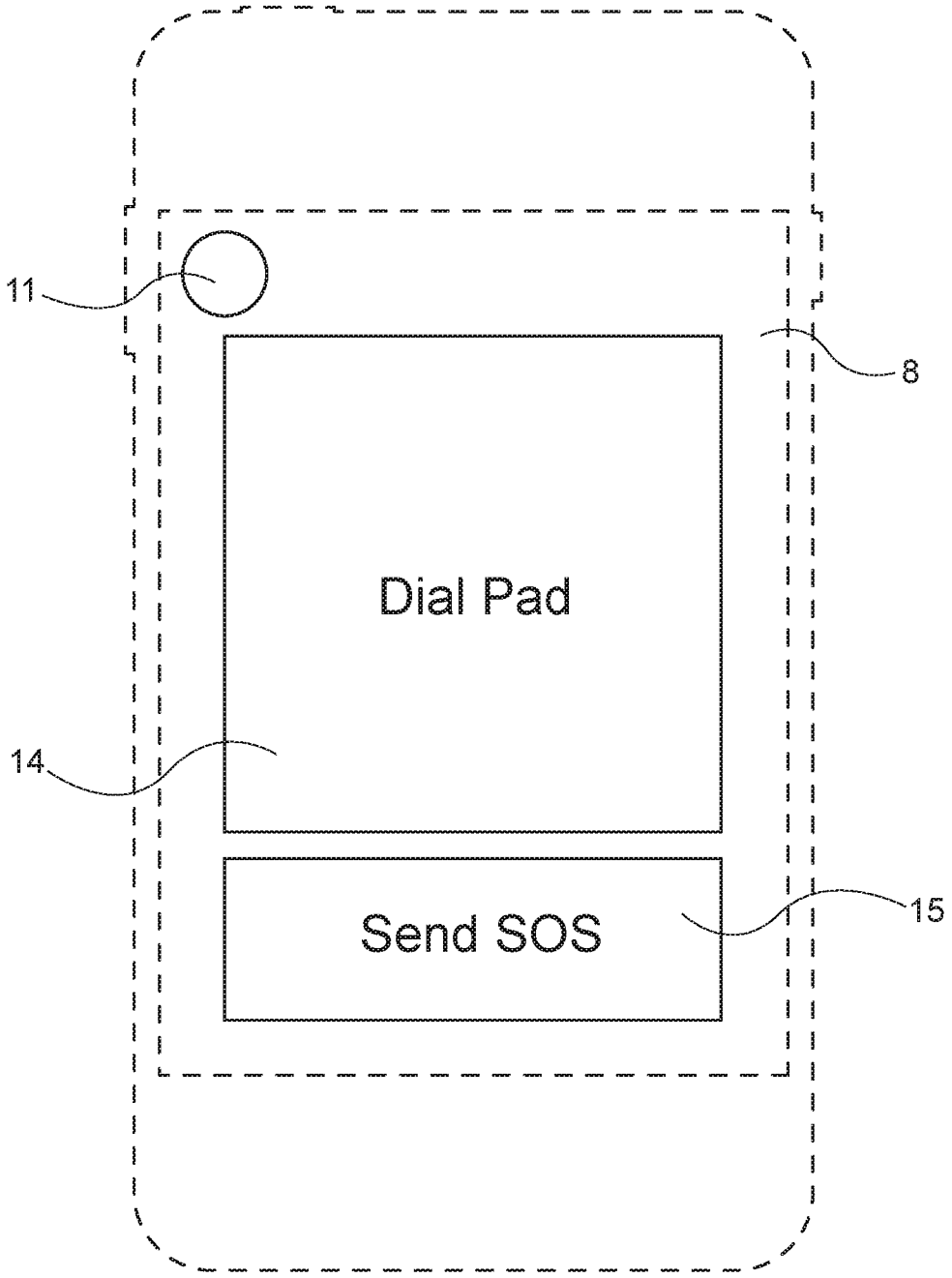
FIG. 8 is a front view of the Multi-Purpose Portable Fan device showing the Dial Pad and the place to send the S.O.S. signal according to an embodiment of the present invention.

Referring now to FIG. 6 showing a front view of the aid request interface for the mobile device application. The aid request interface may be activated by a user selecting the aid request position on the three-position switch on the handle of the hand-held style fan. The aid request interface may include a text input box for a user to input a personal identification number and a selection button to activate the global positioning system-enabled location transmitter, which may signal aid request service providers that a person may be in distress. The personal identification number may be required to be correctly input to activate the aid request notification.

Activation of the global positioning system-enabled location transmitter may simultaneously change the color of the LED lights on the user's fan array to a red color. Further, activation of the signal for aid request service providers may also change the color of the LED lights to a red color on event fan assemblies proximate to the user to provide a visual signal to aid request service providers.

The exact specifications, materials used, and method of use of the Multi-Purpose Portable Fan system may vary upon manufacturing.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

DETAILED SUMMARY

In at least one embodiment the present invention is a Multi-Purpose Portable Fan, comprising:

a portable fan;

at least one custom proprietary software application;

at least one computer and/or smart device.

The Multi-Purpose Portable Fan can be foldable. If fan is a foldable fan in a folded stage it can be sized small enough to fit in a standard size pocket.

The Multi-Purpose Portable Fan can also be a hand-held fan.

The fan may additional be comprised of at least one of the following: at least one light; at least one LED light; an array of lights; a lighting system or device.

The fan can have a handle.

The handle if present can additionally be comprised of at least one of the following: at least one switch, at least one multi selection, activation or mode switch, at least three-position switch, a global positioning system-enabled location transmitter, a universal serial bus port, a solar panel, a battery status display, at least one light or at least one LED light or an array of lights, a wiring interface for LED lights, and a mobile device application interface.

If present the at least three-position switch if present may have an off position, an LED light position, and an aid request position.

The at least one custom proprietary software application AKA the mobile device application, may be a mobile device application that enables the device to enhance the atmosphere at an event and to have the ability to summon aid request service personnel when needed includes at least one of the following: a sign-in interface, a color-select interface, and an aid request interface.

The sign-in interface if present may include text input interfaces for a user name and password and/or the color-select interface if present can allow a user to select colors and patterns for the fan array with LED lights to display when illuminated.

The fan in at least one embodiment additionally comprises at least one battery compartment.

The said at least one light; at least one LED light; an array of lights; a lighting system or device are controlled by either an on-off activation switch, or an at least 3 position switch, or a multi-selection and/or activation switch and/or remotely controlled, or controlled by a wireless remote control and/or switch.

The handle at least one light is controlled by either an on-off activation switch, or an at least 3 position switch, or a multi-selection and/or activation or mode switch and/or remotely controlled, or controlled by wireless remote control.

LED lights if present is configured to be a plurality of nestable blades. The plurality of nestable blades may be configured to spread into a half-circle formation for use, and to retract into a stack for storage.

The plurality of nestable blades if present may have a plurality of LED lights, wiring, and a wiring connector that may be able to couple with the wiring interface. The array with LED lights if present can be configured to be a plurality of nestable blades. The plurality of nestable blades may be configured to spread into a half-circle formation for use, and to retract into a stack for storage.

The plurality of nestable blades if present may have a plurality of LED lights, wiring, and a wiring connector that may be able to couple with the wiring interface in the handle.

The remotely controlled element, if present, can be controlled by at least one custom proprietary software application running in at least one computer, server, and/or smart device.

The said lights and/or lighting system can be comprised of LED lights.

The said lights and/or lighting system can include synchronization of the lights from internal circuitry and/or custom proprietary software or a remote source.

The said synchronization of the lights and/or lighting system can control the light patterns so as to create at least one of: letters, numbers, images, phrases, text, content, words, sentences, icons, emoji's, characters, images, photographs, content, media, logo's, icons, brands, animation, 2-D and 3-D characters.

The said switch if present can be placed in the LED light position, the fan array with LED lights may illuminate and a wireless signal may be sent to the user's mobile device which may activate the associated mobile device application.

The switch if present can be placed in the aid request position, a wireless signal may be sent to the user's mobile device which may activate the associated mobile device application, and may simultaneously change color of the fan array with LED lights to a red color.

The switch if present can be placed in the LED light position, the fan array with LED lights may illuminate and a wireless signal may be sent to the user's mobile device which may activate the associated mobile device application.

The switch if present can be placed in the aid request position, a wireless signal may be sent to the user's mobile device which may activate the associated mobile device application, and may simultaneously change color of the fan array with LED lights to a red color.

The color-select interface if present further includes selections for plural lights to display.

The color-select interface if present can exclude the color red. Or any color.

The aid request interface if present includes may include a text input box for a user to input a personal identification number and a selection interface to activate the global positioning system-enabled location transmitter, which may transmit a signal to notify aid request service providers that a person may be in distress and said selection interface if present will activate the global positioning system-enabled location transmitter may also change the color of the LED lights on the user's fan array, as well as event fan assemblies proximate to the user, to a red color to reference for aid request service providers The said battery compartment assembly if present may further be comprised of a battery recharging device.

The universal serial bus port may have an interface to the female connector receiver of a mobile device and may further be configured to transfer energy from the solar panel if present to charge the battery of the mobile device. The battery status display if present may be configured to show the battery power available of the mobile device when connect to the universal serial bus port. The Multi-Purpose Portable Fan may additionally comprise of at least one transmitter and/or receiver.

The Multi-Purpose Portable Fan contains circuitry for GPS locating. The transmitter and/or receiver, if either is present, may be involved in the said GPS locating process. The GPS locating features if present are utilized in finding the user in aid request and/or other situations. The Multi-Purpose Portable Fan may additionally include a music system, speakers and accompanying circuitry, audio component, or music/audio apparatus. The music system or apparatus is synchronized with the said lights and/or lighting system. The at least one button if present activates said fan to perform at least one of the following: send out a message, signal or alert; vibrate; light-up, audio respond; have the GPS track the time and last location; notify of the last location; send an alert. The button if present could have an S.O.S feature whereby once the button is pushed, it will alert all the fans in the event area within a thirty-foot radius and change to a specified color and also will send a signal to alert the proper authorities and show the area of where the person is in need of assistance and allows for the user or person(s) in need to receive the necessary assistance as fast as possible by using GPS location detection. In at least one embodiment the mobile application registers the fan owners in a database and allows all fan owners to meet and greet each other virtually and if, for instance, a fan owner would like to meet someone or a group they can FAN IN (Like) or FAN OUT (Dislike) the person and during meeting approach of each other when in close proximity, both fans would light up and the lights would start dancing until they connect as the GPS is used to identify the location of the fans. In at least one embodiment the fan allows for user to cool themselves off.

The said fan and associated app allows for the crowds to network with each other and meet new people.

The invention in at least one embodiment is additionally comprised of a solar powered USB that is able to charge phones and/or other items. The invention in at least one embodiment allows for the effect of having many of the said fans in the event allows for the ability to have them synchronized so as to illuminate and light up the entire festival with an app that will be able to control the LED color of the fan.

A method of using the present invention in at least one embodiment includes placing the three-position switch in the LED light position to illuminate the fan array with LED lights, sending a wireless signal to the user's mobile device, and activating an associated mobile device application where the user may be able select the color, and alternately the flashing pattern, of the LED lights. Placing the three-position switch in the aid request position may send a wireless signal to the user's mobile device, which may activate the associated mobile device application and the global positioning system-enabled location transmitter to signal aid request service providers that a person is in distress. Concurrently, the user's fan array with LED lights may change to display a red color and fan assemblies proximate to the user's fan array with LED lights may also switch to display a red color.

While the instant invention has been shown and described in accordance with preferred and practical embodiments thereof, it is recognized that departures from the instant disclosure are contemplated within the spirit and scope of the present invention. Therefore, the true scope of the invention should not be limited since other modifications will become apparent to those skilled in the art upon a study of the claims, drawings, descriptions, explanations, and specifications herein. It is understood that various changes and modifications can be made within the spirit and scope of the present invention.

Those skilled in the art will appreciate that the conception, upon which this disclosure is based, may readily be utilized as a basis for the designing of other structures and methods for carrying out several purposes of the present invention. It is therefore important that the claims be regarded as including such equivalent constructions insofar as they do not depart from the spirit and scope of the present invention. As opposed to the claims, the abstract is neither intended to define the invention of the instant application, which is measured by the claims, nor is it intended to be limiting as to the scope of the invention in any way.

What is claimed as being new and desired to be protected by Letters Patent of the United States is as follows:

1. A fan device, comprising:

a handle configured with a multi-position switch; and a portable fan comprising a plurality of separate distinct blades, wherein the plurality of separate distinct blades are configured to extend into an open configuration to display a fan array of illuminable elements, and retract into a closed stackable configuration;

wherein bottom ends of all of the plurality of separate distinct blades are stacked parallel inside of the handle, in the closed configuration, and the handle comprises a top end and a bottom wall, a front wall that is substantially parallel to a back wall, and opposing side walls connecting the front wall to the back wall, the bottom wall connects the front wall to the back wall, wherein the handle is coupled to the bottom ends of each of the plurality of separate distinct blades at the top end of the handle, wherein the bottom wall of the handle is spaced away from the plurality of separate distinct blades along a length of the handle, wherein the handle comprises: at least one computing device, in communication with the illuminable elements, wherein when the multi-position switch is placed in a first position, the fan array of illuminable elements are illuminated in a first color and a wireless signal is transmitted to a mobile device to activate an associated mobile device application, and when the multi-position switch is placed in a second position, the fan array of illuminable elements are changed to a second color to signal for aid, wherein the first color is different than the second color.

2. The fan device of claim 1, wherein the fan device further comprises a battery compartment assembly coupled to the handle, wherein the battery compartment assembly comprises a battery charging device.

3. The fan device of claim 2, wherein the battery charging device comprises solar cells, the fan is powered by solar energy and sun rays are used to power a battery pack configured to charge the mobile device.

4. The fan device of claim 1, wherein the computing device comprises a transmitter and a receiver.

5. The fan device of claim 1, wherein the associated mobile device application is configured to allow a user to select at least one of: a color of the illuminable elements, or a flashing pattern of the illuminable elements.

6. The fan device of claim 1, wherein the second color is red and the first color is a color different than red.

7. The fan device of claim 1, wherein the plurality of separate distinct blades are configured to spread into a half-circle formation in the open configuration and retract into a stack in the closed stackable configuration.

8. The fan device of claim 1, wherein the computing device further comprises a global positioning system-enabled transmitter.

9. The fan device of claim 8, wherein the global positioning system enabled transmitter is configured to transmit a global position of the fan device to another computing device.

10. The fan device of claim 9, wherein the computing device further comprises a text input box and a selection interface to activate the global positioning system enabled transmitter.

11. The fan device of claim 1, wherein the computing device is configured to coordinate a synchronized secondary display with at least one auxiliary fan device, wherein the fan device and the at least one auxiliary fan device both comprise constituent parts of the synchronized secondary display.

12. The fan device of claim 1, further comprising a universal serial bus port configured as a female connector.

13. The fan device of claim 1, wherein the computing device further comprises an audio system that includes at least one speaker and configured to synchronize an audio-visual output with the display of illuminated elements.

14. A method for operating a fan device, the fan device comprising: a handle configured with a multi-position switch, and a portable fan comprising a plurality of separate distinct blades configured to extend into an open configuration and retract into a closed stacked configuration, wherein distinct blades of the plurality of separate distinct blades are configured to display a fan array of illuminable elements;

wherein bottom ends of all of the plurality of separate distinct blades are stacked parallel inside of the handle, in the closed stacked configuration; and the handle comprises a top end and a bottom wall, a front wall that is substantially parallel to a back wall, and opposing side walls connecting the front wall to the back wall, the bottom wall connects the front wall to the back wall, wherein the handle is coupled to bottom ends of each of the plurality of separate distinct blades at the top end of the handle, wherein the bottom wall of the handle is spaced away from the plurality of separate distinct blades along a length of the handle, wherein the handle comprises: at least one computing device, in communication with the illuminable elements;

wherein the method comprises:

transitioning the fan device from the closed stacked configuration to the open configuration by extending the plurality of separate distinct blades;

when the multi-position switch is placed in a first position, illuminating the fan array of illuminated elements in a first color and transmitting a signal to an auxiliary computing device by the computing device of the fan device;

when the multi-position switch is placed in a second position, changing the fan array of illuminable elements to a second color to signal for aid, wherein the first color is different than the second color.

15. The method of claim 14, wherein the signal identifies the location of a user of the fan device based on a global positioning of the fan device.

16. The method of claim 15, wherein the signal is transmitted in a radius of at least 30 feet from the fan device.

17. A system, comprising: a fan device, comprising:

a handle configured with a multi-position switch; and a portable fan comprising a plurality of nestable separate and distinct blades, wherein nestable separate and distinct blades of the plurality of nestable separate and distinct blades are configured to display a fan array of illuminable elements, and wherein the handle comprises:

a top end and a bottom wall, a front wall that is substantially parallel to a back wall, and opposing side walls connecting the front wall to the back wall, the bottom wall connects the front wall to the back wall, wherein the handle is coupled to bottom ends of each of the plurality of nestable separate and distinct blades at the top end of the handle, wherein the bottom wall of the handle is spaced away from the plurality of nestable separate and distinct blades along a length of the handle;

a computing device, the computing device comprising:

a wiring interface coupled to the plurality of nestable separate and distinct blades;

a memory having computer-executable instructions encoded thereon, and a processor functionally coupled to the memory and configured by the computer-executable instructions to:

transmit a status signal to at least one external computing device, wherein the status signal comprises an indication of an open configuration of the fan device or an indication of a closed configuration of the fan device;

receive a response signal from the at least one external computing device based on the status signal;

when the multi-position switch is placed in a first position, emit an external display in at least a first color, via the illuminable elements, based on the response signal received from the at least one external computing device; and when the multi-position switch is placed in a second position, the fan array of illuminable elements are changed to a second color to signal for aid, wherein the first color is different than the second color.

18. The system of claim 17, wherein the status signal is transmitted based on global positioning of the fan device to the at least one external computing device.

19. The system of claim 17, wherein the processor is further configured by the computer-executable instructions to update the external display based on the proximity of the response signal to the fan device.

* * * * *